US005972853A

United States Patent [19]

Boffa et al.

[11] Patent Number: 5,972,853

[45] Date of Patent: Oct. 26, 1999

[54] WEAR CONTROL WITH DISPERSANTS EMPLOYING POLY ALPHA-OLEFIN POLYMERS

[75] Inventors: Alexander B. Boffa, Glen Gardner; Thomas R. Bidwell, Hightstown, both of N.J.

[73] Assignee: Exxon Chemical Patents Inc., Linden, N.J.

[21] Appl. No.: 08/968,036

[22] Filed: Nov. 12, 1997

[51] Int. Cl.[6] ..... C10M 161/00

[52] U.S. Cl. ..... 508/371

[58] Field of Search ..... 508/371, 375

[56] References Cited

U.S. PATENT DOCUMENTS

| | | | |
|---|---|---|---|
| 5,277,833 | 1/1994 | Song et al. | 508/241 |
| 5,631,211 | 5/1997 | Nakagawa et al. | 508/371 |
| 5,681,797 | 10/1997 | Lawate | 508/371 |
| 5,726,134 | 3/1998 | Adams | 508/241 |
| 5,733,852 | 3/1998 | Adams | 508/241 |
| 5,747,596 | 5/1998 | Emert et al. | 508/221 |

*Primary Examiner*—Jacqueline V. Howard

[57] ABSTRACT

A lubricating oil composition comprising oil, and an additive combination comprising a poly alpha-olefin polymer dispersant with a number average molecular weight above 2500, and a metal dihydrocarbyl dithiophosphate sufficient to yield a phosphorous content of up to 0.1 percent weight based on the total weight of the oil. The poly alpha-olefin polymer can be ethylene alpha-olefin copolymer such as ethylene-1-butene or ethylene-1-butene-hydrocarbyl polyamine. Preferably, the ethylene-1-butene-hydrocarbyl polyamine has a number average molecular weight of about 3300.

17 Claims, No Drawings

WEAR CONTROL WITH DISPERSANTS EMPLOYING POLY ALPHA-OLEFIN POLYMERS

BACKGROUND OF THE INVENTION

Lubricating oil compositions, such as crankcase oils, contain various additives to improve their performance. Among the additives are dispersants which keep harmful particles suspended in the oil. These dispersants are often functionalized polymers wherein the polymer is a poly alpha-olefin such as polyisobutylene.

The polyisobutylene polymers (PIB) employed in most conventional dispersants are based on a hydrocarbon chain of a number average molecular weight ($M_n$) of from about 900 to 2500. PI having a $M_n$ of less than about 300 gives rather poor performance results when employed in dispersants because the molecular weight is insufficient to keep the dispersant molecule fully solubilized in lubricating oils. On the other hand, high molecular weight PIB ($M_n$>3000) becomes so viscous that conventional industrial practices are incapable of handling this product in many operations. In addition, dispersants containing PIB result in significant engine wear in low phosphorous formulations or when used with dihydrocarbyl dithiophosphate DDP metal salts containing primary alcohol groups.

Since DDP metal salts with primary alcohol groups and low phosphorous oil formulations are very desirable in increasing fuel efficiency, it would be advantageous to use a dispersant that has good antiwear performance in low phosphorous oil formulations and in the presence of primary DDP metal salts. This is surprisingly accomplished in the present invention by using dispersants containing poly alpha-olefin polymer backbones with a molecular weight above 2500 ($M_n$>2500).

SUMMARY OF THE INVENTION

This invention comprises a lubricating oil composition comprising a poly alpha-olefin polymer dispersant with a number average molecular weight above 2500, and a phosphorous content (from metal DDP) of up to 0.1 percent weight based on the total weight of the oil. This provides a composition with good fuel efficiency and reduced engine wear.

The invention also includes a method for lubricating an engine with this formulation in order to obtain the advantages shown above.

DETAILED DESCRIPTION OF THE INVENTION

The additives of the present invention find their primary utility in lubricating oil compositions which employ a base oil in which the additives are dissolved or dispersed therein. Such base oils may be natural or synthetic. Base oils suitable for use in preparing the lubricating oil compositions of the present invention include those conventionally employed as crankcase lubricating oils for spark-ignited and compression-ignited internal combustion engines, such as automobile and truck engines, marine and railroad diesel engines, and the like. Advantageous results are also achieved by employing the additive mixtures of the present invention in base oils conventionally employed in and or adapted for use as power transmitting fluids, universal tractor fluids and hydraulic fluids, heavy duty hydraulic fluids, power steering fluids and the like. Gear lubricants, industrial oils, pump oils and other lubricating oil compositions can also benefit from the incorporation therein of the additives of the present invention.

These lubricating oil formulations conventionally contain several different types of additives that will supply the characteristics that are required in the formulations. Among these types of additives are included viscosity index improvers, antioxidants, corrosion inhibitors, detergents, dispersants, pour point depressants, antiwear agents, friction modifiers, etc.

The additives of the present invention, particularly those adapted for use as dispersants or viscosity modifiers, can be incorporated into a lubricating oil in any convenient way. Thus, they can be added directly to the oil by dispersing or dissolving the same in the oil at the desired level of concentrations of the additive. Such blending into the additional lube oil can occur at room temperature or elevated temperatures. Alternatively, the additives can be blended with a suitable oil-soluble solvent and base oil to form a concentrate, and then blending the concentrate with a lubricating oil basestock to obtain the final formulation. Such dispersant concentrations will typically contain (on an active ingredient (A.I.) basis) from about 10 to about 80 wt. %, typically about 20 to about 60 wt. %, and preferably from about 40 to about 50 wt. %, additive, and typically from about 40 to 80 wt. %, preferably from about 40 to 60 wt. %, base oil, i.e., hydrocarbon oil based on the concentration weight. MFVI concentrates typically will contain from about 5 to about 50 wt. % AI.

The lubricating oil basestock for the additive typically is adapted to perform a selected function by the incorporation of additional additives therein to form lubricating oil compositions (i.e., formulations).

Usually these concentrations may be diluted with 3 to 100, e.g., 5 to 40 parts by weight of lubricating oil, per part by weight of the additive package, in forming finished lubricants, e.g. crankcase motor oils. The purpose of concentrates, of course, is to make the handling of the various materials less difficult and awkward as well as to facilitate solution or dispersion in the final blend. Thus, the additives of the present invention and formulations containing them would usually be employed in the form of a 40 to 50 wt. % concentrate, for example, in a lubricating oil fraction.

The additives of the present invention will be generally used in admixture with a lube oil basestock, comprising an oil of lubricating viscosity, including natural and synthetic lubricating oils and mixtures thereof Useful oils are described in U.S. Pat. Nos. 5,017,299 and 5,084,197.

Natural oils include animal oils and vegetable oils (e.g., castor, lard oil) liquid petroleum oils and hydrorefined, solvent-treated or acid-treated mineral lubricating oils of the paraffinic, naphthenic and mixed paraffinic-naphthenic types. Oils of lubricating viscosity derived from coal or shale are also useful base oils.

Synthetic lubricating oils include hydrocarbon oils and halosubstituted hydrocarbon oils such as polymerized and interpolymerized olefins (e.g., polybutylenes, polypropylenes, propylene-isobutylene copolymers, chlorinated polybutylenes, etc.) poly(hexenes), poly(1-octenes), poly(1-decenes), etc. and mixtures thereof; alkylbenzenes (e.g., dodecyl-benzenes, tetradecyl-benzenes, dinonylbenzenes, di-(2-ethylhexyl)-benzenes, etc.); polyphenyls (e.g., biphenyls, terphenyls, alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide, the alkyl and aryl ethers of these polyoxyalkylene polymers (e.g., methyl-poly isopropylene glycol ether having an average molecular weight of 1000, diphenyl ether of polyethylene glycol having a molecular weight of 500 to 1,000, diethyl ether of polypropylene glycol having a molecular weight of 1,000 to 1,500; and mono- and polycarboxylic esters thereof, for example, the acetic acid esters, mixed $C_3$ to $C_8$ fatty acid esters and $C_{13}$ Oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of these esters include dibutyl adipate, di(2-ethylhexyl)sebacate, di-n-hexyl fumarate, dioctyl sebacate, diisooctyl azelate, diisodecyl azelate, dioctyl phthalate didecyl phthalate, dieicosyl sebacate, the 2-ethylhexyl diester of linoleic acid dimer, and the complex ester formed by reacting 1 mole of sebacic acid with 2 moles of tetraethylene glycol and 2 moles of 2-ethylhexanoic acid.

Esters useful as synthetic oils also include those made from $C_5$ and $C_{12}$ monocarboxylic acids and polyols and polyol esters such as neopentyl glycol, trimethylolpropane, pentaerythritol, dipentaerythritol and tripentaerythritol.

Silicon-based oils such as the polyalkyl-, polyaryl-, polyalkoxy-, or polyaryloxysiloxane oils and silicate oils comprise another useful class of synthetic lubricants; they include tetraethyl silicate, tetraisopropyl silicate, tetra-(2-ethylhexyl)silicate, tetra-(4-methyl-2-ethylhexyl)silicate, tetra-(p-tert-butylphenyl)silicate, hexa-(4-methyl-2-pentoxy) disiloxane, poly(methyl)siloxanes and poly (methyl-phenyl)siloxanes. Other synthetic lubricating oils include liquid esters of phosphorus-containing acids (e.g., tricresyl phosphate, trioctyl phosphate, diethyl ester of decylphosphonic acid) and polymeric tetrahydrofurans.

Unrefined, refined and rerefined oils can be used in the lubricants of the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be an unrefined oil. Refined oils are similar to the unrefined oils except they have been further treated in one or more purification steps to improve one or more properties. Many such purification techniques, such as distillation, solvent extraction, acid or base extraction, filtration or percolation are known to those skilled in the art. Rerefined oils are obtained by processes similar to those used to obtain refined oils applied to refined oils which have been already used in service. Such rerefined oils are also known as reclaimed or reprocessed oils and often are additionally process by techniques for removal of spent additives and oil breakdown products.

DISPERSANT

An oil dispersant comprises an oil soluble polymeric hydrocarbon backbone having functional groups that are capable of associating with particles to be dispersed. The present invention provides a lubricating oil composition comprising a poly alpha-olefin polymer dispersant with a number average molecular weight above 2500. The lubricating oil composition may further comprise at least one poly alpha-olefin polymer dispersant with a number average molecular weight of up to 2500.

Typically, the dispersants comprise amine, alcohol, amide, or ester polar moieties attached to the polymer backbone often via a bridging group. The dispersant may be, for example, selected from oil soluble salts, esters, amino-esters, amides, imides, and oxazolines of long chain hydrocarbon substituted mono and dicarboxylic acids or their anhydrides; thiocarboxylate derivatives of long chain hydrocarbons; long chain aliphatic hydrocarbons having a polyamine attached directly thereto; and Mannich condensation products formed by condensing a long chain substituted phenol with formaldehyde and polyalkylene polyamine, and Koch reaction products.

The oil soluble polymeric hydrocarbon backbone is typically an olefin polymer, especially polymers comprising a major molar amount (i.e., greater than 50 mole %) of $C_2$ to $C_{18}$ olefin e.g., ethylene, propylene, butylene, isobutylene, pentene, octene-1, styrene), and typically a $C_2$ to $C_5$ olefin. The oil soluble polymeric hydrocarbon backbone may be a homopolymer (e.g., polypropylene or polyisobutylene) or a copolymer of two or more of such olefins (e.g., copolymers of ethylene and an alpha-olefin such as propylene and butylene or copolymers of two different alpha-olefins). Other copolymers include those in which a minor molar amount of the copolymer monomers, e.g., 1 to 10 mole %, is an alpha, omega-diene, such as a $C_3$ to $C_{22}$ non-conjugated diolefin (e.g., a copolymer of isobutylene and butadiene, or a copolymer of ethylene, propylene and 1,4-hexadiene or 5-ethylidene-2-norbomene). Atactic propylene oligomer typically having $M_n$ of from 700 to 5000 may also be used as described in EP-A490454, as well as heteropolymers such as polyepoxides.

One preferred class of olefin polymers is polybutenes and specifically polyisobutenes (PIB) or poly-n-butenes, such as may be prepared by polymerization of a $C_4$ refinery stream. Another preferred class of olefin polymers is ethylene alpha-olefin (EAO) copolymers or alpha-olefin homo- and copolymers such as may be prepared using the new metallocene chemistry having in each case a high degree (e.g., >30%) of terminal vinylidene unsaturation. The term alpha-olefin is used herein to refer to an olefin of the formula:

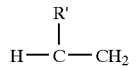

wherein $R^1$ is preferably a $C_1$–$C_{16}$ alkyl group. The requirement for terminal vinylidene unsaturation refers to the presence in the polymer of the following structure:

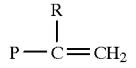

wherein P is the polymer chain and R is a $C_1$–$C_{16}$ alkyl group, typically methyl or ethyl. Preferably the polymers have at least 50% of the polymer chains with terminal vinylidene unsaturation. EAO copolymers of this type preferably contain 1 to 50 wt.% ethylene, and more preferably 50 to 45 wt.% ethylene. Such polymers may contain more than one alpha-olefin and may contain one or more $C_3$ to $C_{22}$ diolefins. Also usable are mixtures of EAO's of low ethylene content with EAO's of high ethylene content. The EAO's may also be mixed or blended with PIB's of various Mn's or components derived from these may be mixed or blended. Atactic propylene oligomer typically having Mn of from 700 to 5000 may also be used, as described in EP-A-490454.

Suitable olefin polymers and copolymers may be prepared by cationic polymerization of hydrocarbon feedstreams, usually $C_3$–$C_5$, in the presence of a reaction promoter (water, alcohol and HCl), and strong Lewis acid catalyst usually an organoaluminum such as $HICl_3$ or ethylaluminum dichloride. Tubular or stirred reactors may be used. Such polymerization and catalysts are described, e.g., in U.S. Pat. Nos. 4,935,576 and 4,952,739. Fixed bed catalyst systems may also be used as in U.S. Pat. Nos. 4,982,045 and U.K. -A-2,001,662. Most commonly, polyisobutylene polymers are derived from Raffinate 1 refinery feedstreams. Conventional Ziegler-Natta polymerization may also be employed to provide olefin polymers suitable for use to prepare dispersants and other additives.

Suitable olefin polymers and copolymers for use herein may be prepared by various catalytic polymerization processes using metallocene catalysts which are, for example, bulky transition metal compounds of the formula:

$$[L]_m[A]_n$$

where L is a bulky ligand; A is a leaving group, M is a transition metal, and me and n are such that the total ligand valency corresponds to the transition metal valency. Preferably the catalyst is four co-ordinate such that the compound is ionizable to a $1^+$ valency state.

The ligands L and A may contain bridges between any two ligands. The metallocene compound may be a full sandwich compound having two or more ligands L which may be cyclopentadienyl ligands or cyclopentadienyl derived ligands, or they may be half sandwich compounds having one such ligand L. The ligand may be mono- or polynuclear or any other ligand capable of h-5 bonding to the transition metal.

One or more of the ligands may p-bond to the transition metal atom, which may be a Group 4, 5 or 6 transition metal and/or a lanthanide or actinide transition metal, with zirconium, titanium and hafnium being particularly preferred.

The ligands may be substituted or unsubstituted, and mono-, di-, tri, tetra- and penta-substitution of the cyclopentadienyl ring is possible. Optionally the substituent(s) may act as one or more bridges between the ligands and/or leaving groups and/or transition metal. Such bridges typically comprise one or more of a carbon, germanium, silicon, phosphorous or nitrogen atom-containing radical, and preferably the bridge places a one atom link between the entities being bridged, although that atom may and often does carry other substituents.

These catalysts are typically used with activators.

The metallocene may also contain a further displaceable figand, preferably displaced by a cocatalyst—a leaving group—that is usually selected from a wide variety of hydrocarbyl groups and halogens.

Such polymerizations, catalysts, and cocatalysts or activators are described, for example, in U.S. Pat. Nos. 4,530,914; 4,665,208; 4,808,561; 4,871,705; 4,897,455; 4,937,299; 4,952,716; 5,017,714; 5,055,438; 5,057,475; 5,064,802; 5,096,867; 5,120,867; 5,124,418; 5,153,157; 5,198,401; 5,227,440; 5,241,025; U.S. Ser. No. 992,690 (filed Dec. 17, 1992); U.S. Ser. Nos. 92/00333; 93/08199 and 93/08221; and 94/07928.

The oil soluble polymeric hydrocarbon backbone of the present invention will usually have a number average molecular weight (Mn) above 2500. Where the component is also intended to have a viscosity modification effect it is desirable to a use higher molecular weight, typically with Mn of from 2,500 to 20,000, and if the component is intended to function primarily as a viscosity modifier then the molecular weight may be even higher with an Mn of from 20,000 up to 500,000 or greater. Preferably, the Mn of the polymers of this invention are above 3,000, most preferably, above 3,300. The functionalized olefin polymers used to prepare dispersants preferably have approximately one terminal double bond per polymer chain.

The Mn for such polymers can be determined by several known techniques. A convenient method for such determination is by gel permeation chromatography (GPC) which additionally provides molecular weight distribution information, see W. W. Yau, J. J. Kirkland and D. D. Bly, "Modem Size Exclusion Liquid Chromatography", John Wiley and Sons, New York, 1979.

The oil soluble polymeric hydrocarbon backbone may be functionalized to incorporate a functional group into the backbone of the polymer, or as one or more groups pendant from the polymer backbone. The functional group typically will be polar and contain one or more hetero atoms such as P, O, S, N, halogen, or boron. It can be attached to a saturated hydrocarbon part of the oil soluble polymeric hydrocarbon backbone via substitution reactions or to an olefinic portion via addition or cyclo addition reactions. Alternatively, the functional group can be incorporated into the polymer in conjunction with oxidation or cleavage of the polymer chain end (e.g., as in ozonolysis).

Useful functionalization reactions include: halogenation of the polymer allylic to the olefinic bond and subsequent reaction of the halogenated polymer with an ethylenically unsaturated functional compound (e.g., maleation where the polymer is reacted with maleic acid or anhydride); reaction of the polymer with an unsaturated functional compound by the "ene" reaction absent halogenation; reaction of the polymer with at least one phenol group (this permits derivatization in a Mannich base-type condensation); reaction of the polymer at a point of unsaturation with carbon monoxide using a hydroformylation catalyst or a Koch-type reaction to introduce a carbonyl group attached to a —$CH_2$— or in an iso or neo position; reaction of the polymer with the functionalizing compound by free radical addition using a free radical catalyst; reaction with a thiocarboxylic acid derivative; and reaction of the polymer by air oxidation methods, epoxidation, chloroamination, or ozonolysis.

The functionalized oil soluble polymeric hydrocarbon backbone is then further derivatized with a nucleophilic reactant such as an amine, amino-alcohol, alcohol, metal compound or mixture thereof to form a corresponding derivative. Useful amine compounds for derivatizing functionalized polymers comprise at least one amine and can comprise one or more additional amine or other reactive or polar groups. These amines may be hydrocarbyl amines or may be predominantly hydrocarbyl amines in which the hydrocarbyl group includes other groups, e.g., hydroxy groups, alkoxy groups, amide groups, nitriles, imidazoline groups, and the like. Particularly useful amine compounds include mono- and polyamines, e.g., polyalkylene and polyoxyalkylene polyamines of about 2 to 60, conveniently 2 to 40 (e.g., 3 to 20) total carbon atoms and about 1 to 12, conveniently 3 to 12, and preferably 3 to 9 nitrogen atoms in the molecule. Mixtures of amine compounds may advantageously be used such as those prepared by reaction of alkylene dihalide with ammonia. Preferred amines are aliphatic saturated amines, including, e.g., 1,2-diaminoethane; 1,3-diaminopropane; 1,4-diaminobutane; 1,6-diaminohexane; polyethylene amines such as diethylene triamine; triethylene tetramine; tetraethylene pentamine; and polypropyleneamines such as 1,2-propylene diamine; and di-(1,3-propylene triamine.

Other useful amine compounds include: alicyclic diamines such 1,4-di(aminomethyl) cyclohexane, and heterocyclic nitrogen compounds such as imidazolines. A particularly useful class of amines are the polyamido and related amido-amines as disclosed in U.S. Pat. Nos. 4,857,217; 4,956,107; 4,963,275; and 5,229,022. Also usable is tris(hydroxymethyl)amino methane (THAM) as described in U.S. Pat. Nos. 4,102,798; 4,113,639; 4,116,876; and UK 989,409. Dendrimers, star-like amines, and comb-structure amines may also be used. Similarly, one may use the condensed amines disclosed in U.S. Pat. No. 5,053,152. The functionalized polymer is reacted with the amine compound according to conventional techniques as described in EP-A 208,560; U.S. Pat. No. 4,234,435 and U.S. Pat. No. 5,229,022.

The functionalized oil soluble polymeric hydrocarbon backbones also may be derivatized with hydroxy compounds such as monohydric and polyhydric alcohols or with aromatic compounds such as phenols and naphthols. Polyhydric alcohols are preferred, e.g., alkylene glycols in which the alkylene radical contains from 2 to 8 carbon atoms. Other useful polyhydric alcohols include glycerol, monooleate of glycerol, monosterate of glycerol, monomethyl ether of glycerol, pentaerythritol, dipentaerythritol, and mixtures thereof An ester dispersant may also be derived from unsaturated alcohols such as allyl alcohol, cinnamyl alcohol, propargyl alcohol, 1-cyclohexane-3-ol, and oleyl alcohol. Still other classes of the alcohols capable of yielding dispersants comprise the ether-alcohols including, for example, oxy-alkylene, oxy-arylene. They are exemplified by ether-alcohols having up to 150 oxy-alkylene radicals in which the alkylene radical contains from 1 to 8 carbon atoms. The ester dispersants may be di-esters of succinic acids or acidic esters, i.e., partially esterified succinic acids; as well as partially esterified polyhydric alcohols or phenols, i.e., esters having free alcohols or phenolic hydroxyl radicals. An ester dispersant may be prepared by one of several known methods as illustrated, for example, in U.S. Pat. No. 3,381,022.

A preferred group of dispersants includes those substituted with succinic anhydride groups and reacted with polyethylene amines (e.g., tetraethylene pentamine), aminoalcohols such as trismethylolaminomethane, polymer products of metallocene catalyzed polymerizations, and optionally additional reactants such as alcohols and reactive metals e.g., pentaerythritol, and combinations thereof). Also useful are dispersants wherein a polyamine is attached directly to the backbone by the methods shown in U.S. Pat. Nos. 5,225,092, 3,565,804 where a halogen group on a halogenated hydrocarbon is displaced with various alkylene polyamines.

Another class of dispersants comprises Mannich base condensation products. Generally, these are prepared by condensing about one more of an alkyl-substituted mono- or polyhydroxy benzene with about 1 to 2.5 moles of carbonyl compounds (e.g., formaldehyde and paraformaldehyde) and about 0.5 to 2 moles polyalkylene polyamine as disclosed, for example, in U.S. Pat. No. 3,442,808. Such Mannich condensation products may include a polymer product of a metallocene catalyzed polymerization as a substituent on the benzene group or may be reacted with a compound containing such a polymer substituted on a succinic anhydride, in a manner similar to that shown in U.S. Pat. No. 3,442,808.

Another class of dispersant includes Koch type dispersants as disclosed in Canadian Patent CA 2110871 herein incorporated by reference.

Examples of functionalized and/or derivatized olefin polymers based on polymers synthesized using metallocene catalyst systems are described in publications identified above.

The dispersant can be further post-treated by a variety of conventional post treatments such as boration, as generally taught in U.S. Pat. Nos. 3,087,936 and 3,254,025. This is readily accomplished by treating an acyl nitrogen-containing dispersant with a boron compound selected from the group consisting of boron oxide, boron halides, boron acids and esters of boron acids or highly borated low $M_w$ dispersant, in an amount to provide a boron to nitrogen mole ration of 0.01–3.0. Usefully the dispersants contain from about 0.05 to 2.0 wt.%, e.g., 0.05 to 0.7 wt.% boron based on the total weight of the borated acyl nitrogen compound. The boron, which appears to be in the product as dehydrated boric acid polymers (primarily $(HBO_2)_3$), is believed to attach to the dispersant nitrogen atoms and as amine salts e.g., a metaborate salt. Boration is readily carried out by adding from about 0.05 to 4, e.g., 1 to 3 wt % (based on the weight of acyl nitrogen compound) of a boron compound, preferably boric acid, usually as a slurry, to the acyl nitrogen compound and heating with stirring at from 135° C. to 190° C., e.g., 140° C.–170° C., for from 1 to 5 hours followed by nitrogen stripping. Alternatively, the boron treatment can be carried out by adding boric acid to a hot reaction mixture of the dicarboxylic acid material and amine while removing water. Additionally other finishing steps such as those disclosed in U.S. Pat. No. 5,464,549, herein incorporated by reference, may be used.

DIHYDROCARBYL DITHIOPHOSPHATE METAL SALTS

Dihydrocarbyl dithiophosphate metal salts are frequently used as anti-wear and antioxidant agents. The metal may be an alkali or alkaline earth metal, or aluminum, lead, tin, molybdenum, manganese, nickel or copper. The zinc salts are most commonly used in lubricating oil in amounts of 0.1 to 10, preferably 0.2 to 2 wt. %, based upon the total weight of the lubricating oil composition. They may be prepared in accordance with known techniques by first forming a dihydrocarbyl dithiophosphoric acid (DDPA), usually by reaction of one or more alcohol or a phenol with $P_2S_5$ and then neutralizing the formed DDPA with a zinc compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the zinc salt any basic or neutral zinc compound could be used but the oxides, hydroxides and carbonates are most generally employed. Commercial additives frequently contain an excess of zinc due to use of an excess of the basic zinc compound in the neutralization reaction.

The preferred zinc dihydrocarbyl dithiophosphates are oil soluble salts of dihydrocarbyl dithiophosphoric acids and may be represented by the following formula:

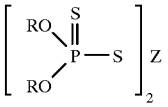

wherein R and R' may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred as R and R' groups are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e., R and R') in the dithiophosphoric acid will generally be about 5 or greater. The zinc dihydrocarbyl dithiophosphate can therefore comprise zinc dialkyl dithiophosphates.

It is desirable to use dihydrocarbyl dithiophosphate metal salts with high percentages of primary alcohol groups and low phosphorous oil formulations in order to increase fuel efficiency. However, this raises the concern of increase in engine wear in tests such as the sequence VE (ASTM D5302) and the GM 6.2L tests. Accordingly, it would be advantageous to use a dispersant that has good antiwear performance in low phosphorous oil formulations and in the presence of primary DDP metal salts. This is surprisingly accomplished in the present invention by using dispersants containing poly alpha-olefin polymer backbones with a molecular weight above 2500 ($M_n$>2500). When such a dispersant is used, oil formulations containing primary DDP metal salts show good antiwear performance comparable to oil formulations containing secondary DDP metal salts. This in turn allows for a decrease in the amount of DDP metal salts present in oil thereby reducing the phosphorous content and further increasing fuel efficiency.

Accordingly, the present invention provides a lubricating oil comprising a poly alpha-olefin polymer dispersant with a number average molecular weight above 2500, and a phosphorous content of up to 0.1 percent weight based on the total weight of the oil. Preferably, the phosphorous content is up to 0.09 percent weight, more preferably, up to 0.06 percent weight based on the total weight of the oil.

EXAMPLE 1

Nissan KA24E Valve Train Wear Test

The Nissan KA24E Valve Train Wear Test is a fired engine, dynamometer lubricant test which evaluates a lubricant's protection performance to reduce camshaft lobe nose wear and rocker arm pad scuffing. Camshaft lobe wear is the primary wear evaluation parameter. The KA24E test is a low temperature, cyclic test with a total running duration of 100 hours.

The KA24E test utilizes a 1994 Nissan model KA24E water cooled, 4 cycle, in-line 4 cylinder engine as the test apparatus. The KA24E engine incorporates a single overhead cam (SOHC), three valve per cylinder (2 intake, 1 exhaust), slider follower valve train design. The engine has a displacement volume of 2389 $cm^3$ (2.4 liter). An engine short block is utilized for 12 tests, a cylinder head assembly is utilized for 6 tests and the critical test parts including the camshaft, rocker arms, rocker shafts and spark plugs are replaced every test. A 95 minute break-in schedule is conducted only when the engine long block is replaced and when the cylinder head is replaced (before tests 1 and 7).

The KA24E test is a flush and run type of lubricant test. Each individual test consists of two 20 minute flushes followed by a 100 hour cyclic test. The cyclic test is comprised of 100 cycles and each cycle is one hour in duration. The test cycle consists of two stages. The engine operates at Stage 1 for a duration of 50 minutes and at stage 2 for 10 minutes. The stages of the test cycle are conducted at the following conditions.

| Parameter | Units | Stage 1 | Stage 2 |
|---|---|---|---|
| Duration | min | 50 | 10 |
| Engine speed | rpm | 800 | 1500 |
| Engine Torque | N-m | 25 | 25 |
| Coolant Out Temperature | ° C. | 50 | 55 |
| Oil Gallery Temperature | ° C. | 50 | 60 |
| Intake Air Temperature | ° C. | 32 | 32 |
| Intake Air Pressure | kpa | 0.050 | 0.050 |
| Intake Air Humidity | g/Kg | 11.5 | 11.5 |
| Exhaust Backpressure | kPa-ABS | 103.5 | 103.5 |
| Coolant Flow | L/m | 30 | 30 |

Before the test is initiated, two 20 minute oil flushes are conducted. The first flush is conducted at Stage 1 conditions and the second flush is conducted at Stage 2 conditions. Once the test cycle is initiated, there are no scheduled intermediate shutdowns and the engine is operated continuously for 100 hours under the conditions mentioned above. At the conclusion of the test, the critical test parts are removed, and wear measurements and scuffing ratings are obtained.

EXAMPLE 2

Cam Nose Wear Results with Different Poly Alpha-Olefin Dispersants

Various oil formulations underwent the Nissan KA24E Valve Train Wear Test described in Example 1. Specifically, two types of dispersants were used in these oil formulations, an ethylene-1-butene polyamine dispersant having an average molecular weight of about 3500 and a polyisobutylene/succinic anhydride polyamine dispersant having an average molecular weight of about 2200. Each dispersant was tested in the presence of zinc dihydrocarbyl dithiophosphate (ZDDP) salt containing either a 15:85 mixture of primary to secondary alcohol groups, a 50:50 mixture of primary to secondary, or all primary. The total phosphorous content was 0.06 or 0.09% based on the total weight for each oil. Each oil contains a full additive package including, in addition to dispersant and ZDDP, metal detergents, antioxidants, friction modifiers, and pour point depressants. Any amount of additive package that prevents wear is appropriate. Such amount is 2 to 40%, preferably 5 to 20% and more preferably 5 to 10% by weight based on the total weight for each oil. The additive package content of the oil formulations tested is between 5 to 10% by weight based on the total weight for each oil with the balance being base oil.

Table 1 shows the results of these experiments. When the polyisobutylene/succinic anhydride polyamine dispersant having an average molecular weight of about 2200 was used, a sharp increase in Cam Nose Wear was observed as primary ZDDP substituted for secondary ZDDP in the oil formulation (ACN=2.58 microns at 100% secondary ZDDP; and ACN=10.02 microns at 100% primary ZDDP). However, when an ethylene-1-butene polyamine dispersant having an average molecular weight of about 3500 was used, only a moderate increase was observed as primary ZDDP substituted for secondary ZDDP in the oil formulation (ACN=2.23 microns at 100% secondary alcohol; ACN=2.58 at 50:50 mixture of primary and secondary ZDDP; and ACN=4.31 at 100% primary ZDDP).

Based on these results, an additional oil was tested at 0.03% phosphorous content based on the total weight for each oil containing ethylene-1-butene polyamine, demonstrating wear performance at a low ZDDP levels.

This surprising result indicates that the use of a poly alpha-olefin dispersant having a number average molecular weight above 2500 gives a better Cam Wear performance in the presence of primary ZDDP and at phosphorous content below 0.1 % based on the total weight of the oil. In turn, this result allows for the use of a higher percentage of primary ZDDP (at the expense of secondary ZDDP) in oil formulations to increase fuel efficiency without compromising engine wear performance. In addition, because of the overall better engine wear performance when a poly a olefin polymer dispersant with a number average molecular weight above 2500 is used, lower concentrations of dihydrocarbyl dithiophosphate metal salts are required for good wear performance which means lower overall phosphorous concentrations in the oil as well.

TABLE 1

| Oil | #1 | #2 | #3 | #4 | #5 | #6 |
|---|---|---|---|---|---|---|
| Dispersant Type | A* | A | A | B** | B | B |
| Primary to secondary ZDDP ratio | 15 | 50 | 100 | 15 | 50 | 100 |
| Phosphorous content, wt % | 0.06 | 0.06 | 0.06 | 0.06 | 0.09 | 0.06 |
| Cam Wear, microns | 2.23 | 2.58 | 4.31 | 2.58 | 7.94 | 10.02 |

*A = ~3500 MW ethylene-1-butene/CO/(7 unit)polyamine dispersant.
**B= ~2200 MW polyisobutylene/succinic anhydride/(6 unit)polyamine dispersant.

What is claimed:

1. A lubricating oil composition comprising a major amount of oil and an antiwear effective amount of an additive combination comprising:

(1) a poly alpha-olefin polymer dispersant with a number average molecular weight above 2500; and (2) a metal dihydrocarbyl dithiophosphate sufficient to yield a phosphorous content of up to 0.1 weight percent based on the total weight of the composition, wherein said metal dihydrocarbyl dithiophosphate contains a preponderance of one or more primary alcohol groups.

2. The lubricating oil composition of claim 1, wherein the phosphorous content is up to 0.09 percent weight based on the total weight of the oil.

3. The lubricating oil composition of claim 1, wherein the phosphorous content is up to 0.06 percent weight based on the total weight of the oil.

4. The lubricating oil composition of claim 1, wherein the poly alpha-olefin polymer dispersant has a number average molecular weight above 3000.

5. The lubricating oil of claim 1, wherein the poly alpha-olefin polymer is ethylene alpha-olefin copolymer.

6. The lubricating oil composition of claim 5, wherein the copolymer is ethylene-1-butene.

7. The lubricating oil composition of claim 5, wherein the copolymer is ethylene-1-butene-hydrocarbyl polyamine.

8. The lubricating oil composition of claim 7, wherein the ethylene-1-butene-hydrocarbyl polyamine has a number average molecular weight of about 3300.

9. The lubricating oil composition of claim 5, wherein the ethylene alpha-olefin copolymer is ethylene-propylene.

10. The lubricating oil composition of claim 1, wherein the metal of the metal dihydrocarbyl dithiophosphate is zinc.

11. The lubricating oil composition of claim 10, wherein the zinc dihydrocarbyl dithiophosphate contains primary alcohol groups only.

12. The lubricating oil composition of claim 1 further comprising at least one poly alpha-olefin polymer dispersant with a number average molecular weight of up to 2500.

13. The lubricating oil composition of claim 1, wherein said antiwear effective amount of an additive combination is 2 to 40% by weight of the total oil composition.

14. A method of lubricating an internal combustion engine by treating the moving surfaces thereof with a lubricating oil composition comprising a major amount of oil and an effective amount of an additive combination comprising:

(1) a poly alpha-olefin polymer dispersant with a number average molecular weight above 2500; and (2) a metal dihydrocarbyl dithiophosphate to sufficient to yield a phosphorous content of up to 0.1 weight percent based on the total weight of the composition, wherein said metal dihydrocarbyl dithiophosphate contains a preponderance of one or more primary alcohol groups.

15. The lubricating oil composition of claim 1, wherein said metal dihydrocarbyl dithiophosphate contains a primary to secondary alcohol ratio from greater than 1:1 to about 15:1.

16. The lubricating oil composition of claim 1, wherein said metal dihydrocarbyl dithiophosphate contains a primary to secondary alcohol ratio from greater than 15:1 to about 50:1.

17. The lubricating oil composition of claim 1, wherein said metal dihydrocarbyl dithiophosphate contains a primary to secondary alcohol ratio from greater than 50:1 to about 100:1.

* * * * *